US007298989B2

(12) United States Patent
Nishimura

(10) Patent No.: US 7,298,989 B2
(45) Date of Patent: Nov. 20, 2007

(54) IMAGE FORMING APPARATUS AND CARTRIDGE WITH HOLDING DEVICE

(75) Inventor: Soichiro Nishimura, Handa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 191 days.

(21) Appl. No.: 11/148,319

(22) Filed: Jun. 9, 2005

(65) Prior Publication Data

US 2005/0276630 A1 Dec. 15, 2005

(30) Foreign Application Priority Data

Jun. 9, 2004 (JP) ..... 2004-171382

(51) Int. Cl.
*G03G 21/16* (2006.01)
*G03G 15/20* (2006.01)
*G03G 15/16* (2006.01)

(52) U.S. Cl. ..... 399/111; 399/313; 399/317

(58) Field of Classification Search ..... 399/111, 399/121, 313, 317
See application file for complete search history.

(56) References Cited

U.S. PATENT DOCUMENTS 5,642,187 A * 6/1997 Nomura et al. ..... 399/111
6,041,203 A 3/2000 Suzuki et al.
6,330,410 B1 12/2001 Okabe et al.
6,411,789 B1 6/2002 Okabe et al.
6,546,217 B2 4/2003 Okabe et al.
6,690,903 B2 2/2004 Okabe et al.
2004/0126132 A1 7/2004 Okabe et al.

FOREIGN PATENT DOCUMENTS

JP 7-168408 7/1995
JP 7-257774 10/1995
JP 2000-267547 9/2000

* cited by examiner

*Primary Examiner*—Hoang Ngo
(74) *Attorney, Agent, or Firm*—Banner & Witcoff, Ltd.

(57) ABSTRACT

A laser printer is configured to move a pinch roller, provided to a main body casing and operating in a position in which the pinch roller obstructs attachment/detachment of a process cartridge, to a position in which the pinch roller does not obstruct attachment/detachment of the process cartridge. Such a configuration can reduce the number of components of the process cartridge compared with the case of incorporating the pinch roller in the process cartridge. In addition, the configuration can reduce the size of the laser printer since it is unnecessary to attach/detach the process cartridge so as to avoid the pinch roller.

23 Claims, 6 Drawing Sheets

IMAGE FORMING APPARATUS AND CARTRIDGE WITH HOLDING DEVICE

CROSS-REFERENCE TO RELATED APPLICATIONS

This application claims the benefit of Japanese Patent Application No. 2004-171382 filed Jun. 9, 2004 in the Japanese Patent Office, the disclosure of which is incorporated herein by reference.

BACKGROUND

The present invention relates to an image forming apparatus provided with an attachable/detachable cartridge and to the attachable/detachable cartridge.

In a conventional image forming apparatus in which an image is formed by supplying toner to an electrostatic latent image formed on a photoconductor drum to form a visual image, and by transferring and fixing the visual image on a sheet of paper, an attachable/detachable cartridge is provided so as to facilitate operations such as replacing consumable components.

In the Publication of Unexamined Japanese Patent Application No. 2000-267547, for example, a process cartridge (a process unit), including a photoconductor drum, a charger, a developing unit, a transfer roller, an upper roller of a set of resist rollers (i.e., a pinch roller arranged so as to face a resist roller), is designed to be attachable/detachable from a front side of a main body casing.

SUMMARY

Using a large number of components for an attachable/detachable cartridge will lead to increased prices of consumables. It is, therefore, preferable that the number of components of the cartridge is reduced as much as possible. Especially, it is preferable to provide components other than consumable components to a main body. However, if a pinch roller is designed to be held by a main body in a configuration described in the Publication of Unexamined Japanese Patent Application No. 2000-267647, for example, the pinch roller will obstruct attachment/detachment of a process cartridge. If, on the other hand, the process cartridge is designed to be detached so as to avoid the pinch roller, an extra space is necessary, which will result in a disadvantage in terms of reducing the size of an image forming apparatus.

The present invention, which has been made in view of these problems, has an object to reduce the number of components of a cartridge and also reduce the size of an image forming apparatus.

In one aspect of the present invention, there is provided an image forming apparatus which comprises an attachable/detachable cartridge, such as a process cartridge, a developing cartridge and a photoconductor cartridge. The image forming apparatus further comprises a roller and a holding device. The roller provided to a main body of the image forming apparatus operates in a first position in which the roller obstructs attachment/detachment of the cartridge. The holding device holds the roller such that the roller is movable from the first position to a second position in which the roller does not obstruct attachment/detachment of the cartridge.

According to the image forming apparatus configured as above, it is possible to provide the roller to the main body of the image forming apparatus, although the roller operates in a position in which the roller obstructs attachment/detachment of the cartridge. This may reduce the number of components of the cartridge. Furthermore, downsizing of the image forming apparatus can be achieved since it is unnecessary to attach/detach the cartridge so as to avoid the roller.

In another aspect of the present invention, there is provided a cartridge provided to an image forming apparatus in an attachable/detachable manner. The cartridge comprises a roller retraction device that abuts a roller thereby to move the roller from a first position to a second position during a detaching operation of the cartridge. In this case, the roller is provided to a main body of the image forming apparatus, operates in the first position in which the roller obstructs attachment/detachment of the cartridge, and is held such that the roller is movable from the first position to the second position in which the roller does not obstruct attachment/detachment of the cartridge.

According to the present cartridge, therefore, an operation of moving the roller from the first position to the second position is not required other than the operation of attaching/detaching the cartridge. Thus, attachment/detachment of the cartridge can be easily performed. Furthermore, this can be realized by a simple configuration as described above.

BRIEF DESCRIPTION OF THE DRAWINGS

A preferred embodiment of the present invention will be described hereinafter with reference to the drawings, in which.

DETAILED DESCRIPTION OF THE PREFERRED EMBODIMENT

Figure 1:
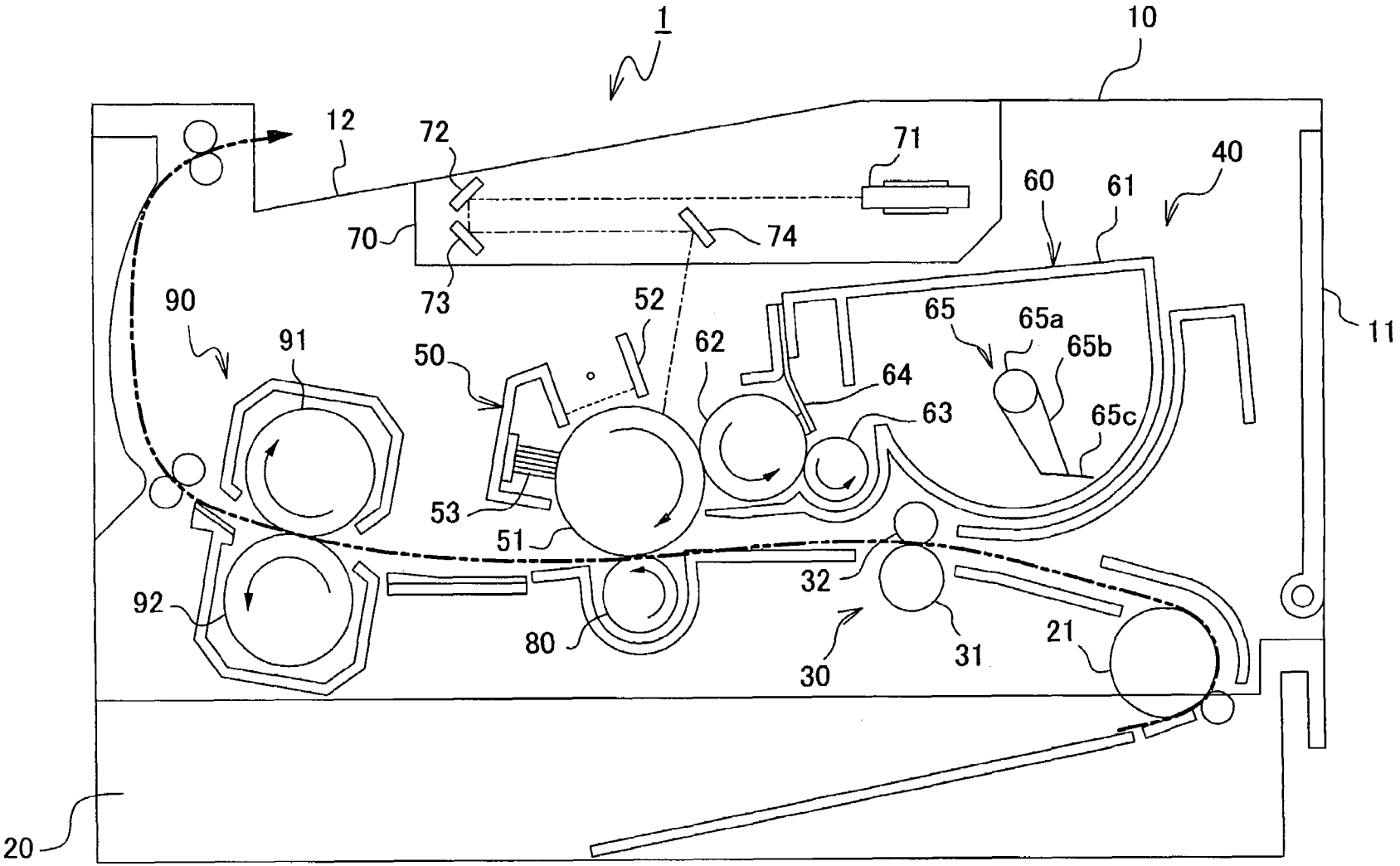
FIG. 1 is a diagrammatic sectional side view of a laser printer of the embodiment.

As shown in FIG. 1, a laser printer 1 is provided with a main body casing 10; and with a paper feed tray 20, a paper feed roller 21, a set of conveyor rollers 30, a process cartridge 40, a scanner unit 70, a transfer roller 80, a fixing unit 90 and others, all being housed in the main body casing 10.

The paper feed tray 20, adapted to store a stacked plurality of sheets of paper as a recording medium, is disposed at the bottom of the main body casing 10 so as to be attachable/detachable to/from the main body casing 10.

The paper feed roller 21 is disposed in an upper side of the paper feed tray 20 and in a front side of the laser printer 1 (on the right side in FIG. 1). The paper feed roller 21 rotatingly driven by a not-shown motor draws the paper stored in the paper feed tray 20 sheet by sheet, and conveys the paper to the set of conveyor rollers 30.

The set of conveyer rollers 30, including a resist roller 31 and a pinch roller (with a metal shaft) 32, convey the paper in a pinched manner in a conveying path of the paper (a path indicated by an arrow in a chain double-dashed line; indicated in the same manner in other figures). The resist roller 31 and the pinch roller 32 are arranged so as to be pressed against each other. When the resist roller 31 is rotatingly driven by a not-shown motor, the pinch roller 32 is followingly rotated by the resist roller 31. By the driving of the set of conveyor rollers 30, a front end of the paper conveyed from the paper feed roller 21 is properly positioned. And then, the paper is conveyed toward a transfer position (i.e., a contact area between an after-mentioned photoconductor drum 51 and the transfer roller 80).

Figure 2:
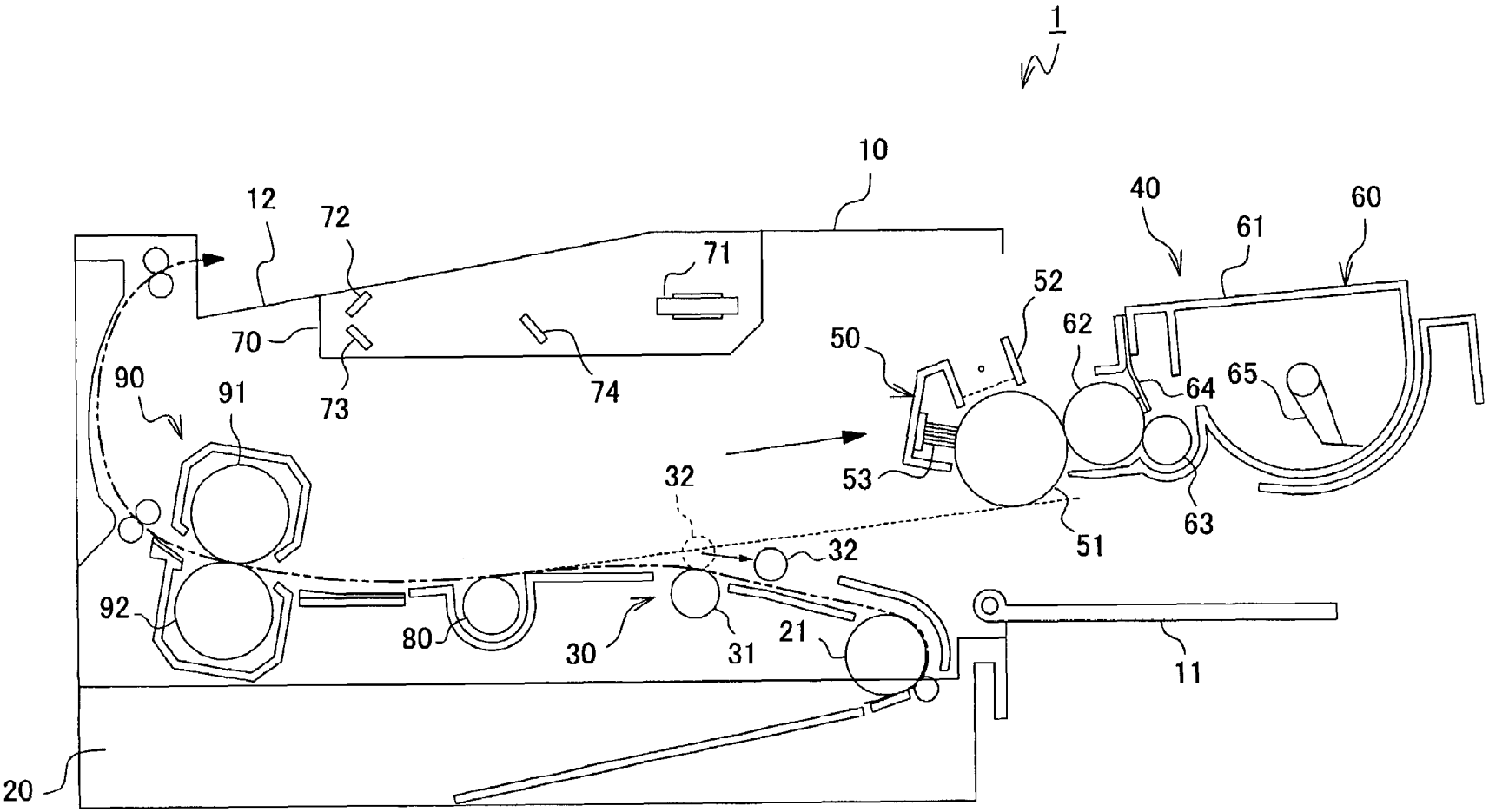
FIG. 2 is a diagrammatic sectional side view of the laser printer with a cover in a opened state.

The process cartridge 40 is attachable/detachable to/from the main body casing 10. Specifically, as shown in FIG. 2, attachment/detachment of the process cartridge 40 can be performed when an openable/closable cover 11, provided to a front side (a right side in the figure) of the main body casing 10, is opened. The process cartridge 40, used in the laser printer 1 of the present embodiment, includes a photoconductor cartridge 50 and a development cartridge 60 attachable/detachable to/from the photoconductor cartridge 50.

The photoconductor cartridge 50 includes a photoconductor drum 51, a scorotron charger 52, and a paper-powder removing brush 53.

The photoconductor drum 51 includes a drum body made of a metal blank tube (including, for example, aluminum) and having a surface covered with a positively chargeable photoconductive layer, including an organic photoconductor containing polycarbonate as a main component. The drum body its grounded. The photoconductor drum 51 is rotatably held by a housing of the photoconductor cartridge 50. The photoconductor drum 51 is rotatingly driven by a not-shown motor in a direction such that the paper conveyed from the set of conveyor rollers 30 is conveyed toward the fixing unit 90 (i.e., the photoconductor drum 51 is rotated in a clockwise direction in FIG. 1).

The scorotron charger 52 is located upstream of an after-mentioned developing roller 62 with respect to the rotating direction of the photoconductor drum 51. The scorotron charger 52 is disposed a predetermined distance apart from the photoconductor drum 51 so as not to contact a surface of the photoconductor drum 51. The scorotron charger 52, which is a charger for positive charging that generates corona discharge from a charging wire of tungsten or the like, positively charges the surface of the photoconductor drum 51 evenly.

The paper-powder removing brush 53 is disposed so as to contact the surface of the photoconductor drum 51 downstream of the transfer roller 80 and upstream of the scorotron charger 52 with respect to the rotating direction of the photoconductor drum 51. Paper powder attached to the surface of the photoconductor drum 51 is removed by the paper-powder removing brush 53.

The development cartridge 60 includes a case 61 attachably/detachably attached to the photoconductor cartridge 50; and a developing roller 62, a supply roller 63, a layer thickness regulating blade 64 and an agitator 65 within the case 61.

The case 61 contains toner as a developing agent. Specifically, a positively chargeable nonmagnetic monocomponent polymerized toner is employed in the laser printer 1 of the present embodiment. The toner is prepared by mixing spherical styrene acrylic resin particles formed by means of a known polymerization method such as a suspension polymerization method, a coloring agent, a charge control agent, a wax and others to form toner base particles, and by adding an additive.

The developing roller 62, including a metal roller shaft covered with a roller of an electrically conductive elastic material such as rubber, is arranged in facing contact with the photoconductor drum 51 through an opening formed in the case 61. The developing roller 62, rotatably held by the case 61, is rotatingly driven by a not-shown motor so as to move in a same direction as the photoconductor drum 51 in a nip point in facing contact with the photoconductor drum 51. That is, the developing roller 62 is rotated in a direction opposite to a rotating direction of the photoconductor drum 51. A developing bias is applied to the developing roller 62.

The supply roller 63, including a metal roller shaft covered with a roller of an electrically conductive sponge material, is arranged in pressure contact with the developing roller 62 within the case 61. The supply roller 63, rotatably held by the case 61, is rotatingly driven by a not-shown motor so as to move in a direction opposite to the developing roller 62 in a nip point in facing contact with the developing roller 62. That is, the supply roller 63 is rotated in a same direction as a rotating direction of the developing roller 62.

The layer thickness regulating blade 64 includes a pressing portion made of insulating silicone rubber having a semicircular cross section provided at an end portion of a blade main body made of a metal plate spring. One end of the blade main body is held by the case 61, and the pressing portion at the other end is pressed, against a surface of the developing roller 62 by an elastic force of the blade main body.

The agitator 65 includes a rotating shaft 65*a*, an agitating member 65*b* extending in a radial direction from the rotating shaft 65*a*, and a sweeping member 65*c* made of a flexible film and provided at a free end of the agitating member 65*b*. The rotating shaft 65*a* is rotatingly driven by a not-shown motor. Then, the agitating member 65*b*, provided in a unified manner with the rotating shaft 65*a*, is rotated in a circumferential direction, and the sweeping member 65*c* uniformly agitates the toner within the case 61.

The scanner unit 70 includes a laser light emitter (not shown), a polygon mirror 71, a lens (not shown), and reflection mirrors 72, 73, and 74. The scanner unit 70 irradiates a laser beam, emitted from the laser light emitter based on image data on a surface of the photoconductor drum 51, in a rapid scanning manner.

The transfer roller 80, including a metal roller shaft covered with a roller of an electrically conductive elastic material such as rubber, is arranged under and in pressure contact with the photoconductor drum 51. The transfer roller 80 is rotatingly driven by a not-shown motor so as to move in a same direction as the photoconductor drum 51 in a nip point in facing contact with the photoconductor drum 51. That is, the transfer roller 80 is rotated in a direction opposite to a rotating direction of the photoconductor drum 51. A transfer bias is applied to the transfer roller 80.

The fixing unit 90 includes a heating roller 91 and a pressure roller 92. The heating roller 91, formed of a metal such as aluminum into a cylindrical shape, is rotatingly driven so as to move in a sane direction as the paper in a contact portion with the pressure roller 92 (i.e., in a clockwise direction in FIG. 1). The heating roller 91, including a heater (e.g. a halogen lamp) therein, is hoatod to a predetermined heating temperature with the heater. The pressure roller 92, including a metal roller shaft covered with a roller of a heat-resistant elastic material such as rubber, is arranged under and in pressure contact with the heating roller 91. The pressure roller 92, which is rotatably held, rotates following a movement of the heating roller 91.

The printing operation of the present laser printer 1 as an image forming operation will next be described.

In the printing operation, the photoconductor drum 51 is rotatingly driven. As a result of the rotation, the surface of the photoconductor drum 51 is positively charged evenly by the scorotron charger 52. When the surface of the photoconductor drum 51 is then exposed by rapid scanning with the laser beam from the scanner unit 70, an electrostatic latent image based on the image data is formed on the photoconductor drum 51.

On the other hand, when the toner is supplied to the developing roller 62 by a rotation of the supply roller 63, the toner is positively charged due to friction between the supply roller 63 and the developing roller 62. In accordance with the rotation of the developing roller 62, the toner on the developing roller 62 enters into a gap between the pressing portion of the layer thickness regulating blade 64 and the developing roller 62. The toner is further frictionally charged in the gap, and is carried on the developing roller 62 as a thin layer having a uniform thickness.

Subsequently, the toner on the developing roller 62 is supplied to the electrostatic latent image formed on the surface of the photoconductor drum 51, that is, a portion having a lower electric potential due to the exposure with the laser beam within the evenly positively charged surface of the photoconductor drum 51. By selectively carrying the toner as above, the electrostatic latent image is visualized. Thus, a toner image is formed on the surface of the photoconductor drum 51.

On the other hand, after the front end of the paper conveyed from the paper supply tray 20 is properly positioned by the set of conveyor rollers 30, the paper is conveyed toward the transfer position (the contact area between the photoconductor drum 51 and the transfer roller 80), and contacts a surface of the photoconductor drum 51.

Then, the toner image on the photoconductor drum 51 is transferred to the paper by the transfer roller 80 to which the transfer bias is applied. The toner image transferred to the paper is thermally fixed to the paper by the fixing unit 90 while the paper passes between the heating roller 91 and the pressure roller 92. Thus, an image is printed on the paper. The paper carrying the printed image is discharged on a paper exit tray 12 provided in all upper part of the main body casing 10.

In the laser printer 1 of the present embodiment, while the process cartridge 40 is attached, the pinch roller 32 is located in a position where the pinch roller 32 obstructs attachment/detachment of the process cartridge 40 (i.e., in a path along which the photoconductor drum 51 passes). Specifically, the pinch roller 32 is provided to the main body casing 10 (the main body of the image forming apparatus), i.e., on a same side as the process cartridge 40 with respect to the conveying path of the paper.

In the laser printer 1 of the present embodiment, as shown in FIG. 2, the process cartridge 40 is designed to be attached/detached in a direction perpendicular to the rotating shaft of the pinch roller 32, that is, in a direction approximately parallel with the conveying direction of the paper in the conveying path. In other words, the process cartridge 40 is attached/detached not from the above or the side but from the front of the image forming apparatus. Accordingly, the pinch roller 32 obstructs attachment/detachment of the process cartridge 40. If the process cartridge 40 is designed to be attached/detached along a path so as to avoid the pinch roller 32, e.g., the process cartridge 40 is designed to be attached/detached by once lifting the process cartridge 40 upward, and then drawing forward of the image forming apparatus, an extra space is necessary. This leads to a disadvantage in reduction of the size of the image forming apparatus.

In the laser printer 1 of the present embodiment, therefore, the pinch roller 32 operates in a normal position (a first position indicated by a dashed line in FIG. 2) during the printing operation, while being moved to a retracted position (a second position indicated by a solid line in FIG. 2) during attachment/detachment of the process cartridge 40 so as not to obstruct the attachment/detachment.

In the present embodiment, "the retracted position during attachment/detachment of the process cartridge 40 so as not to obstruct the attachment/detachment" means a position that allows an abutting portion for restoration 55 (aftermentioned) to abut the pinch roller 32, but may prevent abutment of the remaining portions of the process cartridge 40 against the pinch roller 32 during the attachment of the process cartridge 40.

Figure 3A:
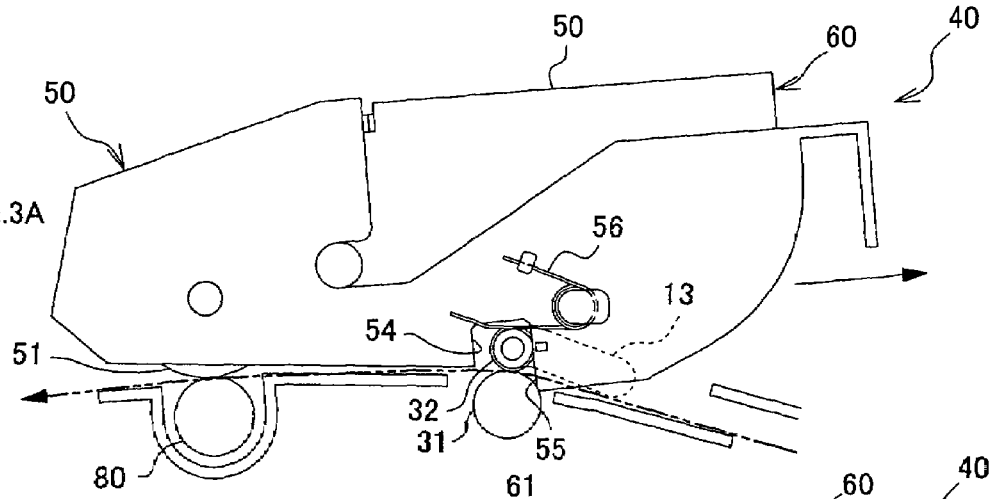
FIGS. 3A, 3B and 3C are explanatory views for illustrating a state of a pinch roller during detachment of a process cartridge.

Specifically, as shown in FIG. 3A, the pinch roller 32 is held by grooves 13 formed in the main body casing 10 in the laser printer 1 of the present embodiment. Each of the grooves 13 is provided on each side of the pinch roller 32 in a direction of a rotation axis so as to extend downward toward a direction of removing the process cartridge 40 (in a right direction in FIGS. 3A, 3B and 3C). The pinch roller 32, having each end in the direction of the rotation axis inserted into the groove 13, is held so as to be movable between the normal position at an upper end portion of the groove 13 and the retracted position at an lower end portion of the groove 13, i.e., within a specified limited range defined by the groove 13.

The process cartridge 40 is provided with an abutting portion for retraction 54 and an abutting portion for restoration 55 in a lower end portion thereof (in a lower end portion of the photoconductor cartridge 50 in the present embodiment). The abutting portion for retraction 54 is used for moving the pinch roller 32 from the normal position to the retracted position in accordance with a detaching operation of the process cartridge 40. The abutting portion for restoration 55 is used for moving the pinch roller 32 from the retracted position to the normal position in accordance with an attaching operation of the process cartridge 40. The abutting portion for retraction 54 and the abutting portion for restoration 55, which are constituted by opposing sides of a recess having an approximately U-shaped configuration, are designed to abut each end of the pinch roller 32 in the direction of the rotation axis, and thereby to directly push and move the pinch roller 32.

The process cartridge 40 (the photoconductor cartridge 50) is also provided with a spring 56 that presses the each end of the pinch roller 32 in the direction of the rotation axis toward the resist roller 31 when the pinch roller 32 is in the normal position, such that the pinch roller 32 is pressed against the resist roller 31.

Figure 3B:
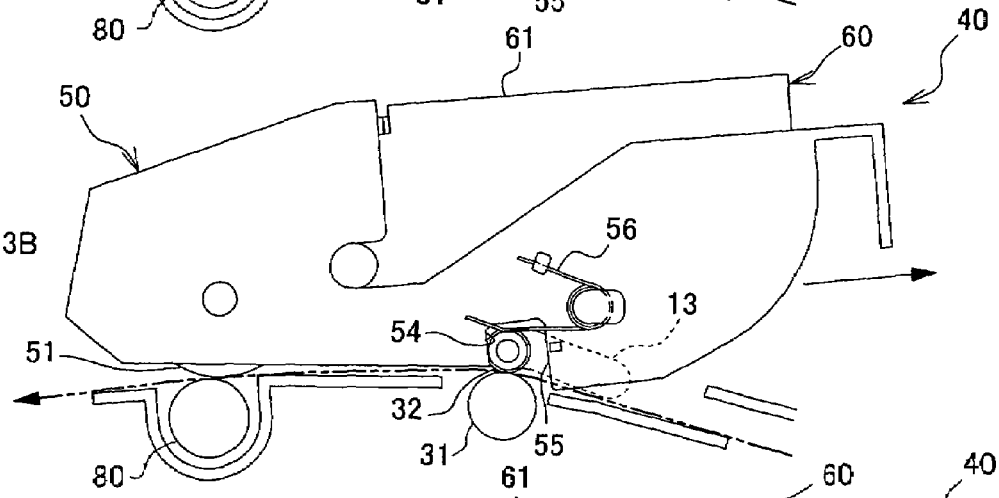
Figure 3C:
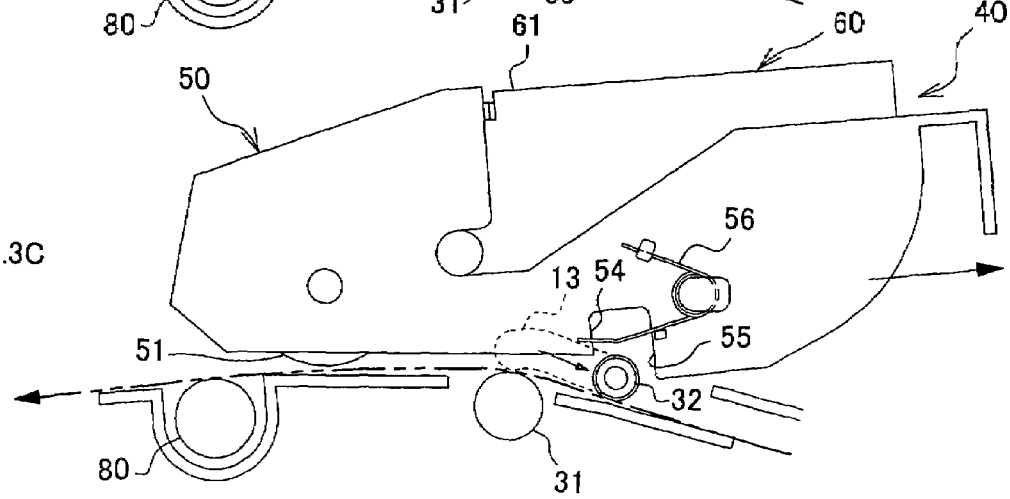

According to the above-described configuration, when the process cartridge 40 is detached from the main body casing 10, a movement of the process cartridge 40 causes the abutting portion for retraction 54 to abut the pinch roller 32 (FIG. 3B). A further movement of the process cartridge 40 causes the pinch roller 32 to be pushed by the abutting portion for retraction 54 and move toward the retracted position (FIG. 3C). This prevents the pinch roller 32 from obstructing the detachment of the process cartridge 40. Once the process cartridge 40 is detached from the main body casing 10, the pinch roller 32 remains in the retracted position (a lower end portion of the groove 13) due to its self weight.

The groove 13 is designed such that the distance between the rotation axis of the pinch roller 32 and the rotation axis of the resist roller 31 is larger in the retracted position than in the normal position (i.e., when the pinch roller 32 is in the retracted position, the pinch roller 32 and the resist roller 31 do not contact with each other in the present embodiment). It is, therefore, possible to release a nip between the pinch roller 32 and the resist roller 31 by detaching the process cartridge 40, thereby to easily remove paper even if a paper jam occurs between the pinch roller 32 and the resist roller 31.

Further, the groove 13 is designed to define the retracted position of the pinch roller 32 as a position which will not cause deformation of paper present in the conveying path. In the present embodiment, the pinch roller 32 is retracted along the conveying path. Accordingly, even when the process cartridge 40 is detached while paper is present in the conveying path, it is possible to prevent the paper from being spoiled by a movement of the pinch roller 32 from the normal position to the retracted position.

Figure 4A:
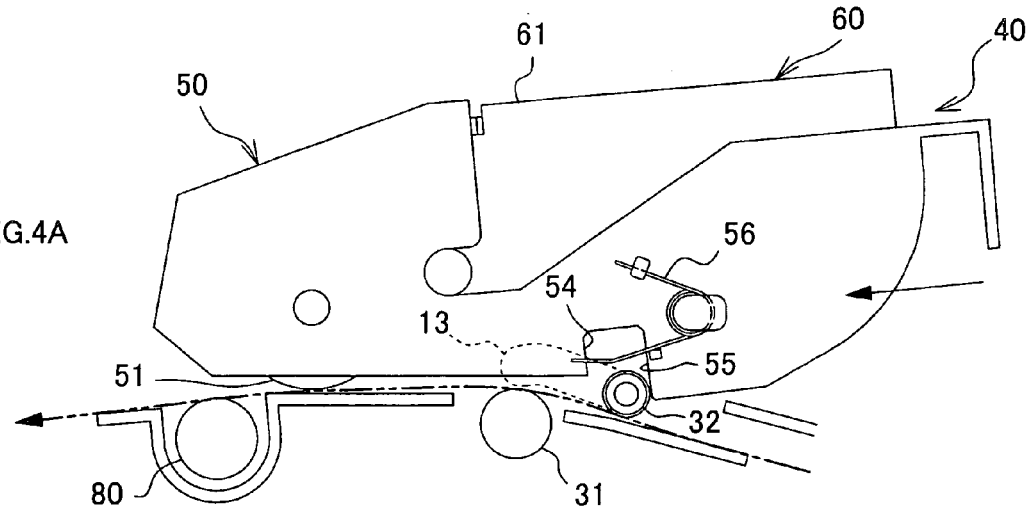
FIGS. 4A, 4B and 4C are explanatory views for illustrating a state of the pinch roller during attachment of the process cartridge.
Figure 4B:
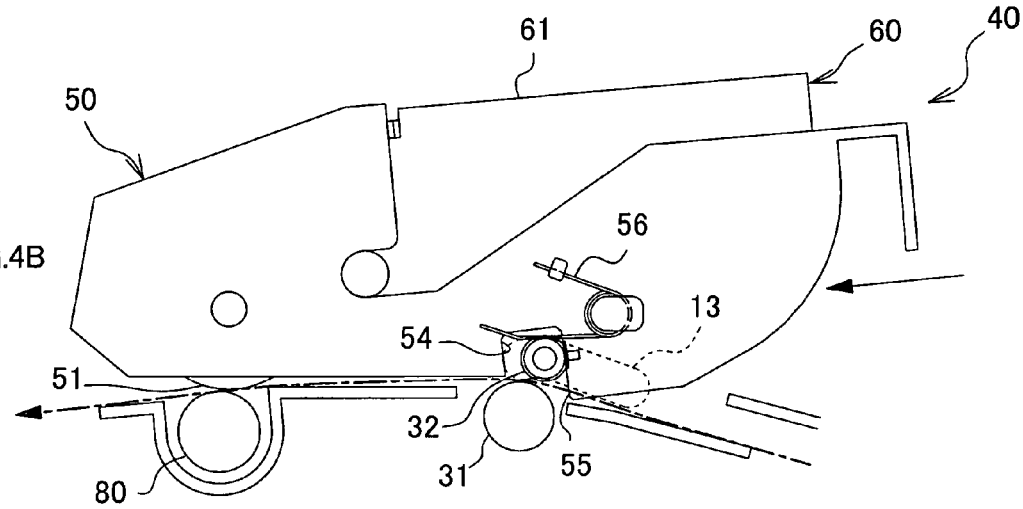
Figure 4C:
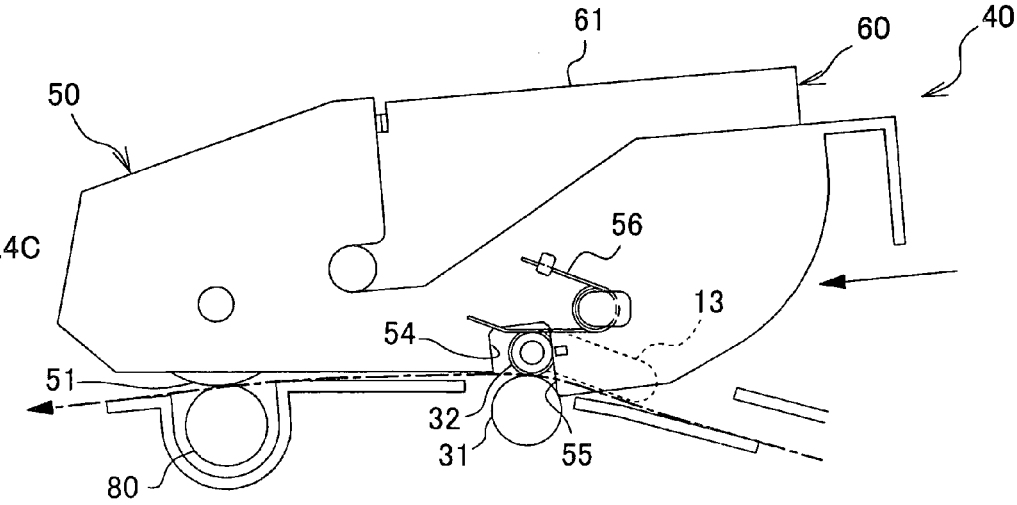

When the process cartridge 40 is attached to the main body casing 10, a movement of the process cartridge 40 causes the abutting portion for restoration 55 to abut the pinch roller 32 (FIG. 4A). A further movement of the process cartridge 40 causes the pinch roller 32 to be pushed by the abutting portion for restoration 55 and move toward the normal position (FIG. 4B). Once the process cartridge 40 is attached to the main body casing 10, the pinch roller 32 is retained in the normal position such that the pinch roller 32 is held by the groove 13 and the abutting portion for restoration 55, and also is pressed against the resist roller 31 by the spring 56.

In the laser printer 1 of the present embodiment, as described above, the pinch roller 32, which is provided to the main body casing 10 and operates in a position where the pinch roller 32 obstructs attachment/detachment of the process cartridge 40, can be moved to a position where the pinch roller 32 does not obstruct attachment/detachment of the process cartridge 40. According to the laser printer 1, therefore, the number of components of the process cartridge 40 can be reduced compared with a case of incorporating the pinch roller 32 in the process cartridge 40. In addition, the size of the image forming apparatus can be reduced since it is unnecessary to attach/detach the process cartridge so as to avoid the pinch roller 32.

Also, in the laser printer 1, an operation of attaching/detaching the process cartridge 40 causes the abutting portion for retraction 54 and the abutting portion for restoration 55, provided to the process cartridge 40, to directly push and move the pinch roller 32. Therefore, any operation of moving the pinch roller 32 other than the operation of attaching/detaching the process cartridge 40 is not required, and attachment/detachment of the process cartridge 40 can be easily performed.

In addition, such a simple configuration as described above can be realized at a lower cost.

Furthermore, since the pinch roller 32 remains in the retracted position due to its self weight once the process cartridge 40 is detached, it is unnecessary to move the pinch roller 32 to the second position, i.e., the retracted position, in preparation for attachment of the process cartridge 40.

Although one embodiment of the present invention has been described as above, it is to be understood that the present invention may be embodied in various forms.

Figure 5A:
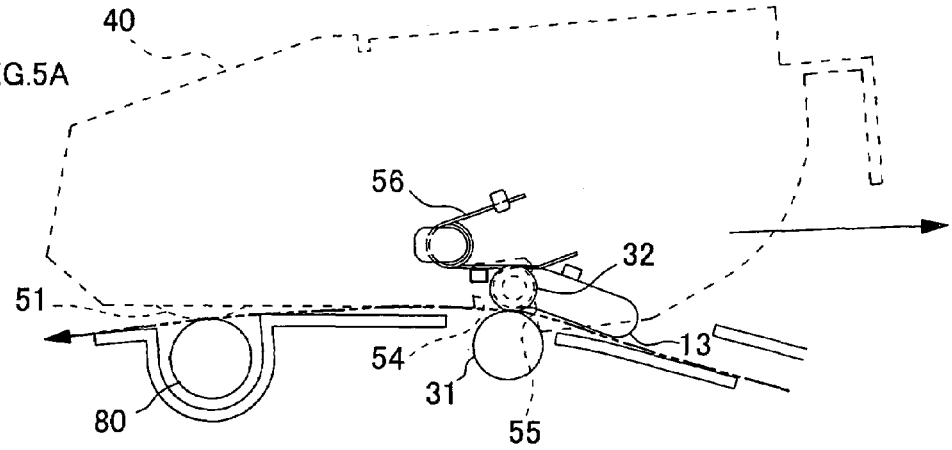
FIGS. 5A, 5B and 5C are explanatory views for illustrating an arrangement of a spring provided to a main body casing.
Figure 5B:
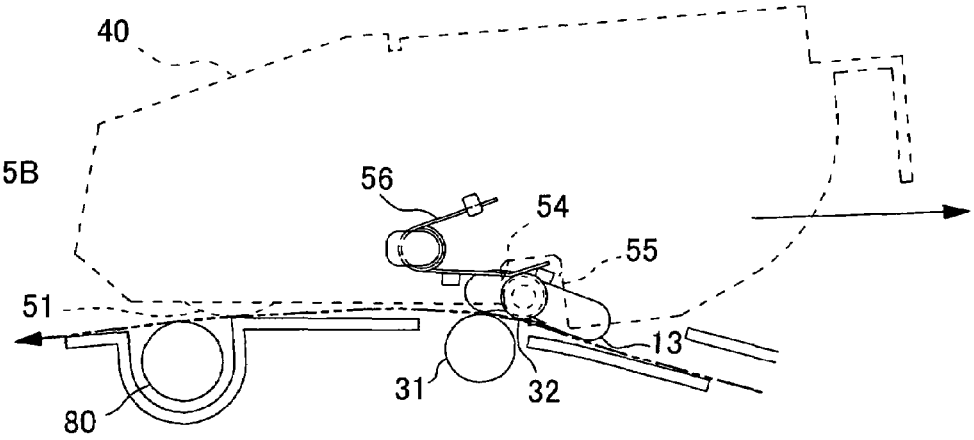
Figure 5C:
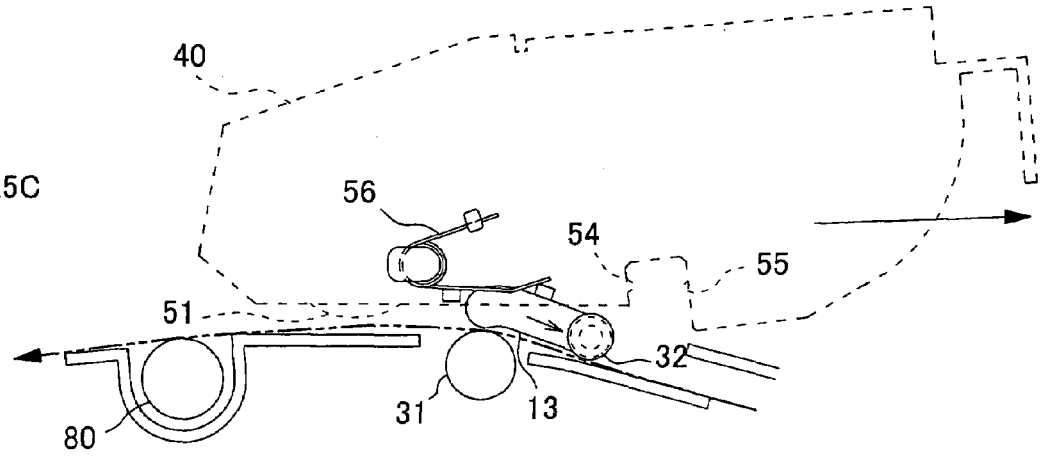

For example, while the spring 56 for pressing the pinch roller 32 toward the resist roller 31 is provided to the process cartridge 40 in the laser printer 1 of the present embodiment, the spring 56 may be provided to the main body casing 10. In this case, while the process cartridge 40 is attached to the main body casing 10 as shown in FIG. 5A, the pinch roller 32 is pressed toward the resist roller 31 by the spring 56 provided to the main body casing 10. When the process cartridge 40 is detached from the main body casing 10, a movement of the process cartridge 40 causes the abutting portion for retraction 54 to abut the pinch roller 32 (FIG. 5B), and a further movement of the process cartridge 40 causes the abutting portion for retraction 54 to push and move the pinch roller 32 toward the retracted position (FIG. 5C). As described above, a configuration including the spring 56 provided to the main body casing 10 achieves the same operation as a configuration including the spring 56 provided to the process cartridge 40. The configuration including the spring 56 provided to the main body casing 10 may further reduce the number of components of the process cartridge 40.

While the pinch roller 32 in the laser printer 1 of the present embodiment is configured to be retained in the normal position such that the pinch roller 32 is held by the groove 13 and the abutting portion for restoration 55, there is no limitation to the configuration of the pinch roller 32.

Figure 6A:
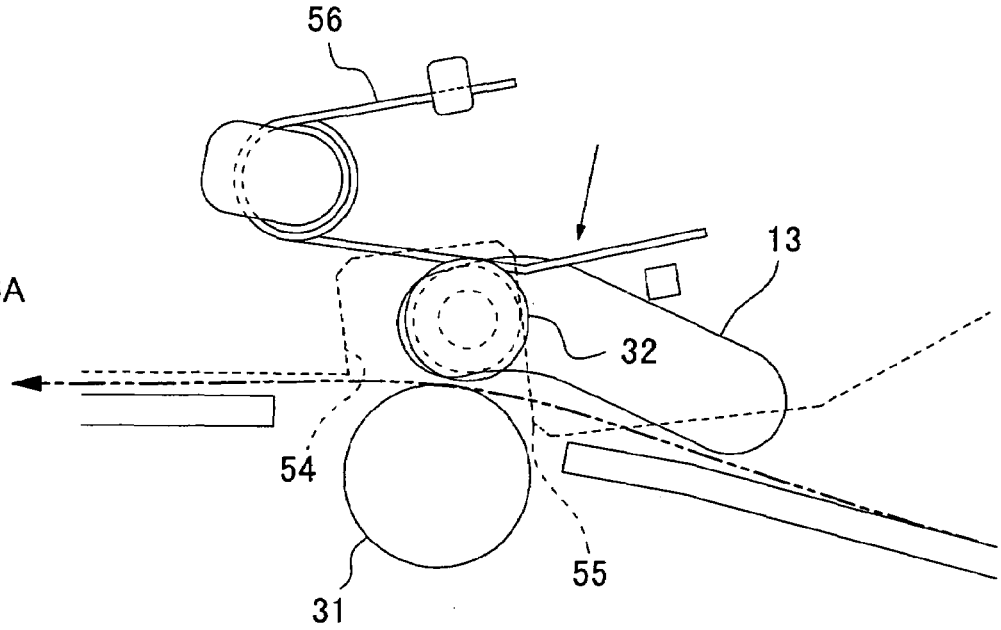
FIGS. 6A and 6B are explanatory views for illustrating an arrangement of a pinch roller held without contact with the process cartridge.
Figure 6B:
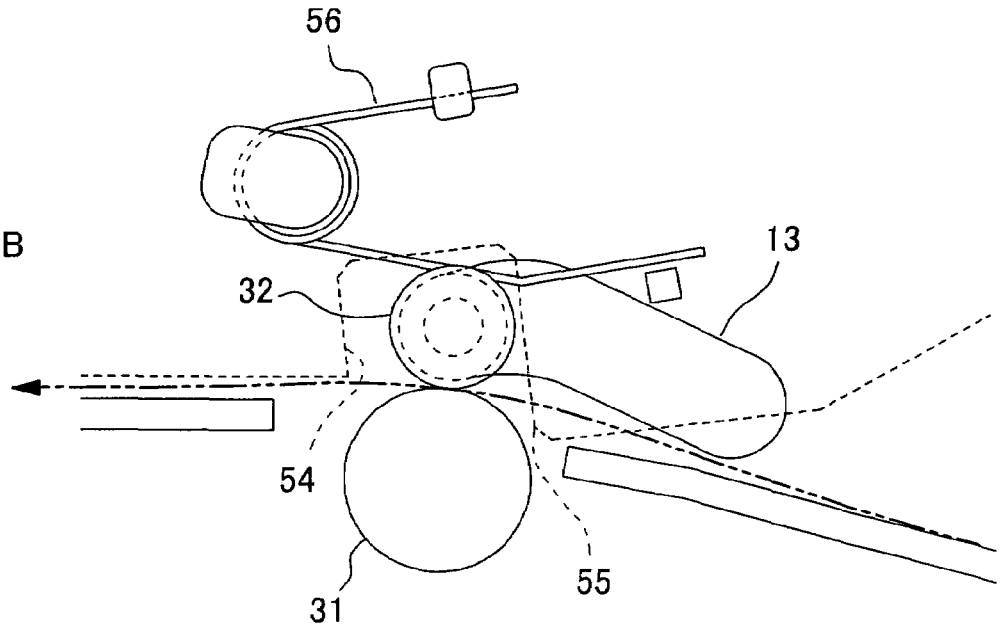

For example, the pinch roller 32 may be configured to be retained (i.e., located) in the normal position without contact with the abutting portion for restoration 55 as shown in FIG. 6B. In the configuration shown in FIGS. 6A and 6B, an upper end portion of the groove 18 slightly declines such that the groove 13 forms a slight reverse V shape. The spring 56 is provided so as to push the pinch roller 32 in a direction of an end of the upper end portion of the groove 13, i.e., so as to prevent the pinch roller 32 from coming off the upper end portion. In this case, when the process cartridge 40 is attached to the main body casing 10, the pinch roller 32 is pushed by the abutting portion for restoration 55 and is moved toward the normal position (toward the end of the upper end portion of the groove 13). In this configuration, even when the process cartridge 40 is moved to be completely attached to the main body casing 10, the abutting portion for restoration 55 pushes the pinch roller 32 to a point slightly short of the normal position (FIG. 6A). The pinch roller 32 is pushed by the spring 56 from the point so as to be retained in the normal position (FIG. 6B). According to the configuration in which the pinch roller 32 is held by the spring 56 without contact with the process cartridge 40, it is possible to prevent oscillation of the pinch roller 32 from being transmitted to the process cartridge 40.

While the groove 13 is provided so as to guide each end of the pinch roller 32 in the rotating direction in a movable manner, in the laser printer 1 of the above-described embodiment, the groove 13 may have other configurations such as a rail, as long as the configurations have the same function of guiding in a movable manner as the groove 13.

In the above-described embodiment, the process cartridge 40 is provided with the abutting portion for retraction 54 and the abutting portion for restoration 55 in a lower end portion thereof to move the pinch roller 32 between the normal position and the retracted position in accordance with an attaching/detaching operation of the process cartridge 40. However, a configuration without these abutting portions 54 and 55 may be employed. In this case, an operation of moving the pinch roller 32 between the normal position and the retracted position is required in addition to an attaching/detaching operation of the process cartridge 40.

In the laser printer 1 of above-described embodiment, the pinch roller 32 is configured to remain in the retracted position duo to its self weight. However, other configurations, such as pressing the pinch roller 32 toward the retracted position due to an elastic force of a spring or the like, may be employed so as to retain the pinch roller 32 in a retracted position.

In the above-described embodiment, the pinch roller 32 is movable between the normal position and the retracted position so as not to obstruct attachment/detachment of the process cartridge 40. However, a roller other than the pinch roller 32 may be configured to be movable. For example, any roller among rollers used in the conveying path of the paper, such as the roller constituting the set of rollers for holding and conveying the paper, may be configured to be movable as above if the roller is likely to obstruct attachment/detachment of the process cartridge 40.

While the spring 56 is provided to press the pinch roller 32 in the normal position against the resist roller 81, other elastic bodies such as rubber may be employed instead of the spring 56, as long as the elastic bodies have the same function as the spring 56.

What is claimed is:

1. An image forming apparatus provided with an attachable/detachable cartridge, the image forming apparatus having a conveying path for a record medium, the forming apparatus comprising:

a roller provided to a main body of the image forming apparatus, the roller operating in a first position on a same side as the cartridge with respect to the conveying path in which the roller obstructs attachment/detachment of the cartridge; and a holding device that holds the roller such that the roller is movable from the first position to a second position in which the roller does not obstruct attachment/detachment of the cartridge.

2. The image forming apparatus according to claim 1, wherein the holding device holds each end portion of the roller in a direction of a rotation axis such that the each end portion is movable within a specified limited range.

3. The image forming apparatus according to claim 1, further comprising a roller retraction device that moves the roller from the first position to the second position in accordance with a detaching operation of the cartridge.

4. The image forming apparatus according to claim 3, wherein the roller retraction device is provided to the cartridge, and abuts the roller thereby to move the roller from the first position to the second position during the detaching operation of the cartridge.

5. The image forming apparatus according to claim 1, wherein the holding device is adapted such that the roller is retained in the second position while the cartridge is detached.

6. The image forming apparatus according to claim 5, wherein the holding device is adapted such that the roller is retained in the second position due to a self weight of the roller.

7. The image forming apparatus according to claim 1, further comprising a roller restoration device that moves the roller from the second position to the first position in accordance with an attaching operation of the cartridge.

8. The image forming apparatus according to claim 7, wherein the roller restoration device is provided to the cartridge, and abuts the roller thereby to move the roller from the second position to the first position during the attaching operation of the cartridge.

9. The image forming apparatus according to claim 1, wherein the holding device is adapted to prevent the recording medium in the conveying path from being deformed due to a movement of the roller from the first position to the second position.

10. The image forming apparatus according to claim 1, wherein the cartridge is disposed on a same side as the roller with respect to the conveying path, and wherein the cartridge is adapted to be attached/detached in a direction approximately parallel with a conveying direction of the recording medium in the conveying path.

11. The image forming apparatus according to claim 1, wherein the cartridge is disposed on a same side as the roller with respect to the conveying path, and wherein the cartridge is adapted to be attached/detached in a direction perpendicular to a rotation axis of the roller.

12. The image forming apparatus according to claim 10, wherein the cartridge includes a photoconductor drum, and wherein the roller is located in a path along which the photoconductor drum passes during attachment/detachment of the cartridge, while the cartridge is attached.

13. The image forming apparatus according to claim 1, wherein the roller constitutes a set of rollers that hold and convey the recording medium in pressure contact with each other.

14. The image forming apparatus according to claim 13, further comprising a pressure contact device that brings the roller into pressure contact with the other roller of the set of rollers.

15. The image forming apparatus according to claim 14, wherein the pressure contact device is provided to the main body of the image forming apparatus.

16. The image forming apparatus according to claim 14, wherein the pressure contact device locates the roller in the first position such that the roller does not contact the cartridge, while the cartridge is attached.

17. The image forming apparatus according to claim 13, wherein the holding device holds the roller such that a distance between rotation axes of the set of rollers in the second position is larger than a distance between rotation axes of the set of rollers in the first position.

18. A cartridge provided to an image forming apparatus in an attachable/detachable manner, comprising:

a roller retraction device that abuts a roller thereby to move the roller from a first position to a second position during a detaching operation of the cartridge, the roller being provided to a main body of the image forming apparatus, operating in the first position on a same side as the cartridge with respect to a conveying path in which the roller obstructs attachment/detachment of the cartridge, and being held such that the roller is movable from the first position to the second position in which the roller does not obstruct attachment/detachment of the cartridge.

19. The cartridge according to claim 18, further comprising a roller restoration device that abuts the roller thereby to move the roller from the second position to the first position during an attaching operation of the cartridge.

20. An image forming apparatus provided with an attachable/detachable cartridge, the image forming apparatus comprising:

a roller provided to a main body of the image forming apparatus, the roller operating in a first position in which the roller obstructs attachment/detachment of the cartridge; and a holding device that holds the roller such that the roller is movable from the first position to a second position in which the roller does not obstruct attachment/detachment of the cartridge, wherein the holding device is adapted such that the roller is retained in the second position while the cartridge is detached.

21. The image forming apparatus according to claim 20, wherein the holding device is adapted such that the roller is retained in the second position due to a self weight of the roller.

22. An image forming apparatus provided with an attachable/detachable cartridge having a photosensitive drum, the image forming apparatus comprising:

a first roller positioned to be opposite to the photosensitive drum when the cartridge is positioned within the image forming apparatus;

a second roller positioned in a first position in which the roller obstructs attachment/detachment of the cartridge; and a holding device that holds the second roller such that the second roller is movable from the first position to a second position in which the second roller does not obstruct attachment/detachment of the cartridge.

23. The image forming apparatus according to claim 22, further comprising a roller restoration device that abuts the second roller thereby to move the second roller from the second position to the first position during an attaching operation of the cartridge.

* * * * *

UNITED STATES PATENT AND TRADEMARK OFFICE

CERTIFICATE OF CORRECTION

PATENT NO. : 7,298,989 B2
APPLICATION NO. : 11/148319
DATED : November 20, 2007
INVENTOR(S) : Soichiro Nishimura It is certified that error appears in the above-identified patent and that said Letters Patent is hereby corrected as shown below:

In Column 9, Claim 1, Line 24:

Please delete "record medium, the forming apparatus" and insert --recording medium, the image forming apparatus--.

Signed and Sealed this

Twenty-sixth Day of May, 2009

John Doll

JOHN DOLL
*Acting Director of the United States Patent and Trademark Office*